US011317727B2

(12) United States Patent
Felkl

(10) Patent No.: US 11,317,727 B2
(45) Date of Patent: May 3, 2022

(54) REVERSIBLE SPRING ASSEMBLY

(71) Applicant: New England Woodcraft, Inc., Brandon, VT (US)

(72) Inventor: Robert Josef Felkl, Cornwall, VT (US)

(73) Assignee: New England Woodcraft, Inc., Brandon, VT (US)

( * ) Notice: Subject to any disclaimer, the term of this patent is extended or adjusted under 35 U.S.C. 154(b) by 0 days.

(21) Appl. No.: 17/117,327

(22) Filed: Dec. 10, 2020

(65) Prior Publication Data

US 2021/0177152 A1 Jun. 17, 2021

Related U.S. Application Data

(60) Provisional application No. 62/946,756, filed on Dec. 11, 2019.

(51) Int. Cl.
*A47C 19/02* (2006.01)
*A47C 19/20* (2006.01)

(52) U.S. Cl.
CPC ..... *A47C 19/025* (2013.01); *A47C 19/202* (2013.01)

(58) Field of Classification Search
CPC ... A47C 19/025; A47C 19/202; A47C 19/207; A47C 19/027; A47C 19/205; A47C 23/063; A47C 23/16; A47C 23/26; A47C 19/20; A47C 23/14; A47C 23/18; A47C 23/125; A47C 23/145; A47C 23/15; A47C 23/155; A47C 23/20
See application file for complete search history.

(56) References Cited

U.S. PATENT DOCUMENTS

| | | | | | |
|---|---|---|---|---|---|
| 737,561 | A * | 9/1903 | Arnold | A47C 19/20 | 5/9.1 |
| 1,224,601 | A * | 5/1917 | Chesley | A47C 19/025 | 5/209 |
| RE22,495 | E * | 6/1944 | Freund | A47C 23/16 | 267/144 |
| 2,581,611 | A * | 1/1952 | Szulce | A47C 23/15 | 5/239 |
| 8,136,183 | B1 * | 3/2012 | Jannetides | A47C 19/028 | 5/282.1 |
| 2007/0294822 | A1 * | 12/2007 | Kenny | A47C 19/20 | 5/9.1 |
| 2014/0159410 | A1 * | 6/2014 | Rasmussen | A47C 17/34 | 296/24.33 |
| 2017/0354264 | A1 * | 12/2017 | Winer | A47C 19/22 | |

* cited by examiner

*Primary Examiner* — Robert G Santos
*Assistant Examiner* — Alison N Labarge
(74) *Attorney, Agent, or Firm* — Fenwick & West LLP

(57) ABSTRACT

A reversible spring assembly is coupled to a bed frame and capable of being inverted from a first position to a second position without detaching the assembly from the bed frame. In one embodiment, the spring assembly includes top and bottom springs arranged in rows within a frame with one or more rigid support bars disposed between the rows of springs. If the user wishes to adjust the position of the assembly in the bed frame (e.g., to create a loft-style configuration), the user need only invert the bed such that the assembly previously positioned at in a right-side-up position at the bottom of the frame is positioned in an inverted position at the top of the frame.

11 Claims, 3 Drawing Sheets

REVERSIBLE SPRING ASSEMBLY

CROSS REFERENCE TO RELATED APPLICATIONS

This application claims the benefit of U.S. Provisional Patent Application Ser. No. 62/946,756, filed Dec. 11, 2019, which is incorporated by reference.

TECHNICAL FIELD

This disclosure generally relates to a spring assembly, and in particular to a reversible spring assembly coupled to a bed frame.

BACKGROUND

Spring assemblies may be positioned at different heights or positions in bed frames to accommodate user preference and/or to allow the user to place furniture or other objects below the bed. However, conventional assemblies typically have only one usable side to support a mattress or other topper such that, if a user wishes to adjust the height of the assembly, the user must detach the assembly from the frame and reposition the assembly at the desired height, which may be a manually intensive and frustrating process.

SUMMARY

This disclosure describes a reversible spring assembly coupled to a bed frame and capable of being inverted from a first position to a second position without detaching the assembly from the bed frame. In one embodiment, the spring assembly includes top and bottom springs of uniform size and thickness arranged in rows within a frame with one or more rigid support bars disposed between the rows of springs. If the user wishes to adjust the position of the assembly in the bed frame (e.g., to create a loft-style configuration), the user need only invert the bed such that the assembly previously positioned at in a right-side-up position at the bottom of the frame is positioned in an inverted position at the top of the frame.

BRIEF DESCRIPTION OF THE DRAWINGS

The disclosed embodiments have advantages and features that will be more readily apparent from the detailed description, the appended claims, and the accompanying figures. A brief introduction to the figures is below.

DETAILED DESCRIPTION

The Figures and the following description relate to preferred embodiments by way of illustration only. It is noted that wherever practicable similar or like reference numbers may be used in the figures and may indicate similar or like functionality. One skilled in the art will readily recognize from the following description that alternative embodiments of the structures and methods illustrated herein may be employed without departing from the principles described herein.

Figure 1:
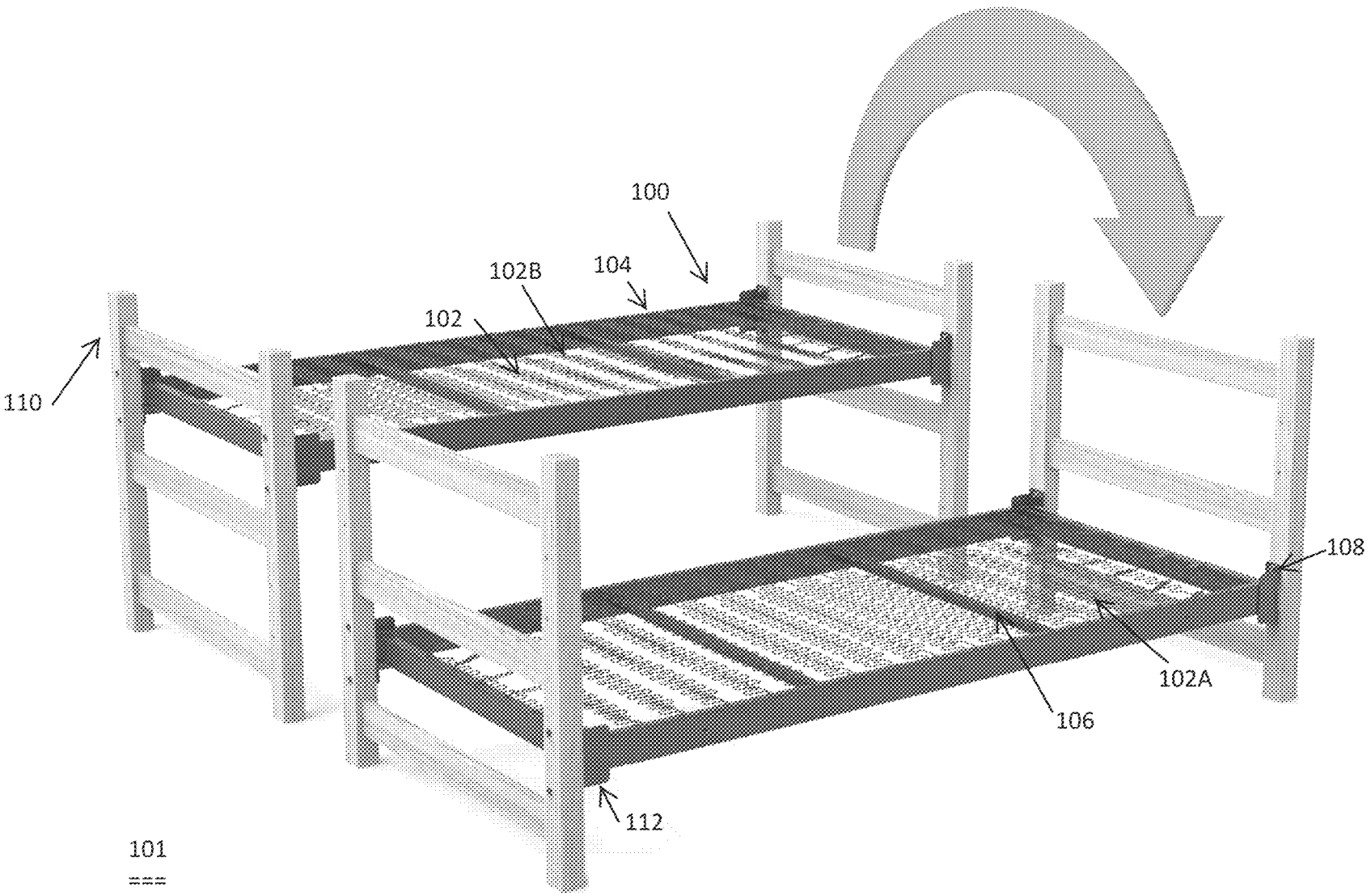
FIG. 1 illustrates a reversible spring assembly for a bed, in accordance with an embodiment.

Referring now to FIG. 1, it illustrates one example embodiment of a reversible spring assembly 100 for a bed 101. In the displayed embodiment, the spring assembly 100 includes a plurality of springs 102 arranged in rows within a rectangular frame 104. Each row of springs 102 is coupled to the frame 104 at a first end and a second end. In various embodiments, the spring assembly 100 is unibody construction or is constructed in multiple pieces and assembled (e.g., by means of welding or other bonding mechanisms). For example, in one embodiment, the springs 102 are constructed separately from the frame 104 and coupled to the frame 104 to form the spring assembly 100.

The spring assembly 100 is made of steel or other metal or rigid material. In one embodiment, the spring assembly 100 is approximately 75 inches long and approximately 38 inches wide (i.e., approximately the size of a twin mattress). However, one of skill in the art will recognize that other embodiments of the spring assembly 100 have different dimensions, for example, to accommodate mattresses or other toppers of various sizes. Further, those skilled in the art will recognize that other materials (e.g., canvas, rope netting) could be configured in the manner taught herein.

The springs 102 include top springs 102A disposed at a top of the frame 104 and bottom springs 102B disposed at a bottom of the frame 104. In one embodiment, the top springs 102A and bottom springs 102B are of uniform size and thickness. When the bed 101 is inverted (as discussed below with respect to FIGS. 2A and 2B), the top springs 102A are disposed at the bottom of the frame 104 and the bottom springs 102B are disposed at the top of the frame 104. For convenience, this description refers to the first position of the spring assembly 100 as a "right-side-up" position (in which the top of the frame 104 is positioned at the top of the spring assembly 100) and the second position of the spring assembly 100 as the "inverted" position (in which the top of the frame 104 is positioned at the bottom of the spring assembly 100), however, one of skill in the art will recognize that because the spring assembly 100 is reversible and the frame 104 and springs 102 are uniform throughout the spring assembly 100, neither position is, in reality, "right-side-up" or "inverted."

Figure 3:
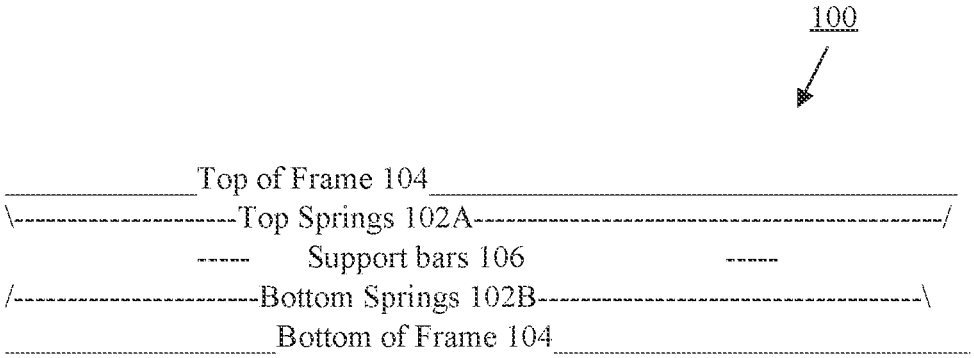
FIG. 3 is a diagrammatic illustration of the reversible spring assembly of FIG. 1, in accordance with an embodiment.

In one embodiment, one or more rigid support bars 106 are disposed between the top springs 102A and the bottom springs 102B and extend across the width of the frame 104 to support the weight of a mattress or other topper placed on top of the spring assembly 100. As shown in FIG. 3, this configuration is further detailed diagrammatically in this side view of the spring assembly 100 in a right-side-up position with the foot of bed 101 to the left, head of bed 101 to the right:

```
_______Top of Frame 104_______
\- - - - - -Top Springs 102A- - - - - -/
- - - - - - Support bars 106 - - - - - -
/- - - - - -Bottom Springs 102B- - - - - -\
_______Bottom of Frame 104_______
```

In the embodiment displayed in FIG. 1, the frame 104 includes two support bars 106, with a first support bar 106A being positioned approximately one-third of the length of the spring assembly 100 from a first end of the assembly 100 and a second support bar 106B being positioned approximately one third of the length of the spring assembly 100 from a second end of the assembly 100 such that the springs 102 appear to be positioned within three sections of the frame 104 and divided by the support bars 106. While FIG. 1 shows two support bars 106, it will be apparent to one of skill in the art that more or fewer support bars 106 may be used (e.g., in embodiments where the spring assembly 100 is larger or smaller than in the embodiment described herein).

The frame 104 further includes an attachment point 108 at each corner of the frame 104 to allow the spring assembly 100 to be coupled to a bed frame 110. For example, in one embodiment, each attachment point 108 includes one or more holes through which a bolt, screw, or other fastener passes to engage with the bed frame 110 to secure the assembly 100 to the bed frame 110. Other attachment mechanisms are used in other embodiments. Still further, in some embodiments, each corner of the frame 104 includes a mattress support 112 to hold a mattress or other topper in place on top of the spring assembly 100 and to prevent the mattress from moving in the frame 104.

Figure 2A:
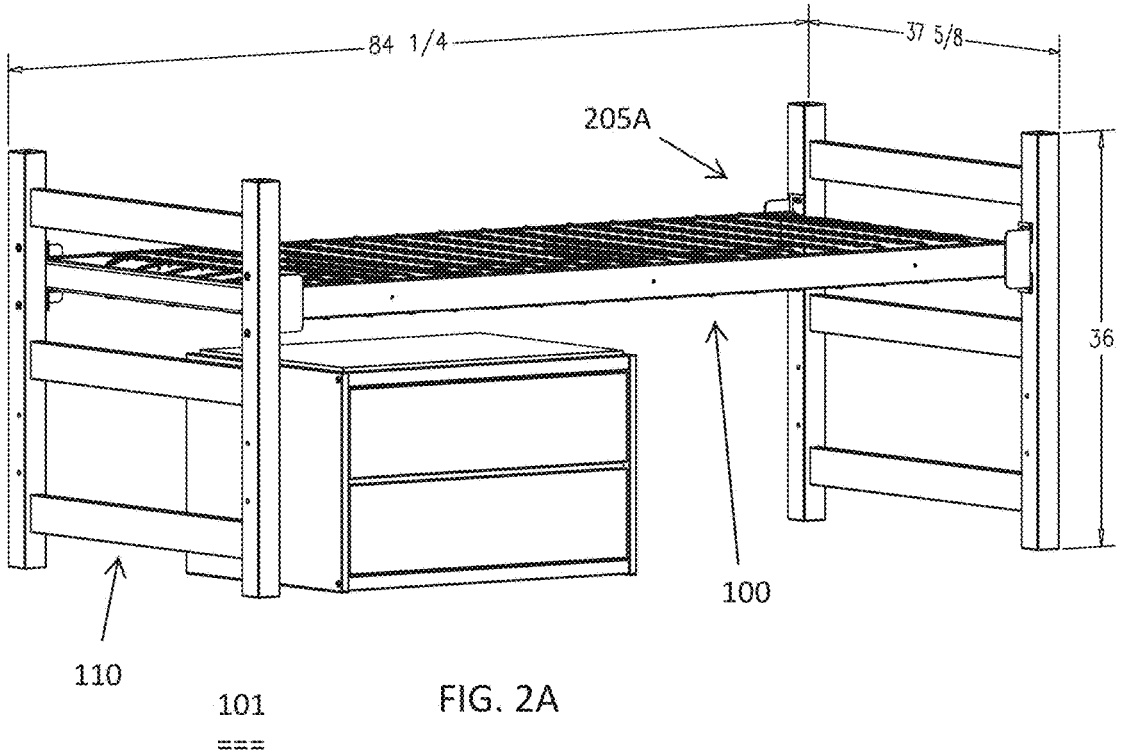
FIG. 2A illustrates a reversible spring assembly configured in a first position in a bed frame, in accordance with an embodiment.
Figure 2B:
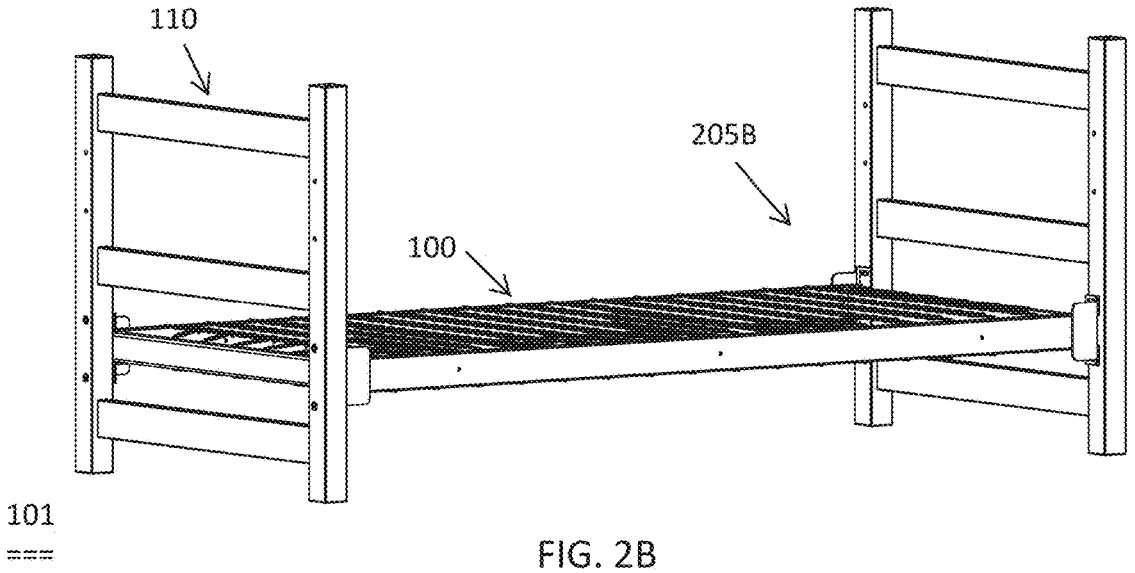
FIG. 2B illustrates a reversible spring assembly configured in a second position in a bed frame, in accordance with an embodiment.

FIGS. 2A and 2B illustrate a reversible spring assembly 100 configured in first and second positions, respectively, in accordance with an embodiment. In one embodiment, the spring assembly 100 is positioned perpendicularly within the bed frame 110 and is configured to be reversible such that the bed 101 is capable of being inverted from a first (right-side-up) position (e.g., the position 205A in FIG. 2A) to a second (inverted) position (e.g., the position 205B in FIG. 2B), or from the second position to the first position, without having to detach the spring assembly 100 from the bed frame 110. For instance, a student living in a dorm room may wish to change the configuration of the bed 101 to allow the student to place a desk, a set of drawers, or other objects below the bed, such as the set of drawers shown in FIG. 2A. If the bed 101 is initially configured in the position 205B, in which the spring assembly 100 is positioned lower to the base of the bed frame 110, the student need only invert the bed 101 to achieve the "loft-style" configuration of the position 205A, in which the spring assembly 100 is positioned near the top of the bed frame 110. Alternatively, in other embodiments, the spring assembly 100 is detached from the bed frame 110 at the attachment points 108 such that the spring assembly 100 is capable of being manually repositioned at a different height within the bed frame 110 (i.e., and such that the bed frame need not be inverted). Additionally, while the embodiment displayed in FIGS. 1 and 2 includes a bed frame 110 that is sized to accommodate a twin mattress, one of skill in the art will recognize that in other embodiments, the bed frame 110 has different dimensions (e.g., cot-size or twin XL size) to accommodate mattresses or other toppers of various sizes and/or a second spring assembly 100. For example, in one implementation, a first spring assembly 100 is positioned at a first height in the bed frame 110, and a second spring assembly 100 is positioned at a second height in the bed frame 110 to accommodate multiple mattresses or other toppers in a bunk-bed configuration.

As used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments. This is done merely for convenience and to give a general sense of the disclosure. This description should be read to include one or at least one and the singular also includes the plural unless it is obvious that it is meant otherwise.

Upon reading this disclosure, those of skill in the art will appreciate still additional alternative structural and functional designs for a system and a process for a reversible spring assembly. Thus, while particular embodiments and applications have been illustrated and described, it is to be understood that the described subject matter is not limited to the precise construction and components disclosed herein and that various modifications, changes and variations which will be apparent to those skilled in the art may be made in the arrangement, operation and details of the apparatus disclosed. The scope of the invention is to be limited only by the following claims.

What is claimed is:

1. A reversible spring assembly comprising:

a plurality of springs arranged in rows within a frame, the plurality of springs including top springs and bottom springs, the top springs disposed at a top of the frame and the bottom springs disposed at a bottom of the frame when the assembly is in a first position, wherein the top springs and the bottom springs are of uniform size and thickness; and one or more support bars disposed between the top springs and the bottom springs and extending across a width of the frame;

the reversible spring assembly coupled to a bed frame by means of an attachment mechanism, the reversible spring assembly and bed frame capable of being inverted from the first position to a second position without detaching the assembly from the bed frame.

2. The reversible spring assembly of claim 1, wherein the top springs are disposed at the bottom of the frame and the bottom springs are disposed at the top of the frame when the assembly is in the second position.

3. The reversible spring assembly of claim 1, wherein the assembly is configured to engage with a topper on a top side of the assembly.

4. The reversible spring assembly of claim 3, wherein the topper is a mattress.

5. The reversible spring assembly of claim 3, wherein the frame has a plurality of corners and wherein the assembly further comprises a topper support at each corner of the frame to hold the topper in place on the top side of the assembly.

6. The reversible spring assembly of claim 3, wherein the assembly is sized to accommodate a twin-sized topper.

7. The reversible spring assembly of claim 6, wherein the topper is a mattress.

8. The reversible spring assembly of claim 1, wherein the frame has a plurality of corners and wherein the assembly further comprises an attachment point at each corner of the frame to allow the assembly to be coupled to the bed frame.

9. The reversible spring assembly of claim 1, wherein the one or more support bars comprise a first support bar being positioned approximately one-third of a length of the assembly from a first end of the assembly and a second support bar being positioned approximately one-third of the length of the assembly from a second end of the assembly.

10. The reversible spring assembly of claim 1, wherein the assembly is positioned near a top of the bed frame when the assembly is in the first position and wherein the assembly is positioned near a bottom of the bed frame when the assembly is in the second position.

11. The reversible spring assembly of claim 1, wherein the bed frame is configured to accommodate a first assembly positioned at a first height in the bed frame and a second assembly positioned at a second height in the bed frame in a bunk-bed configuration.

* * * * *